United States Patent [19]

Kosiarski et al.

[11] Patent Number: 4,835,060

[45] Date of Patent: May 30, 1989

[54] ELECTRICAL CONNECTOR

[75] Inventors: Joseph P. Kosiarski, Linden; Ming Shen, Lakewood, both of N.J.

[73] Assignee: Tecknit, Cranford, N.J.

[21] Appl. No.: 97,509

[22] Filed: Sep. 16, 1987

[51] Int. Cl.[4] ..... H01R 3/00; H01R 43/00

[52] U.S. Cl. ..... 428/447; 439/331; 439/586; 29/877

[58] Field of Search ..... 339/17 A; 428/447; 439/331, 586; 29/877

[56] References Cited

U.S. PATENT DOCUMENTS

| | | | |
|---|---|---|---|
| 3,971,610 | 7/1976 | Buchoff et al. . | |
| 3,982,320 | 9/1976 | Buchoff et al. . | |
| 4,144,648 | 3/1979 | Grörender | 439/331 |
| 4,344,662 | 8/1982 | Dalamangas et al. | 439/331 X |
| 4,729,166 | 3/1988 | Lee et al. | 439/586 X |

*Primary Examiner*—Nancy A. B. Swisher

*Attorney, Agent, or Firm*—John N. Bain; Raymond J. Lillie

[57] ABSTRACT

An improved electrical connector which has improved durability and stability when exposed to low temperature the connector comprises alternating layers of electrically conductive and non-conductive material. The electrically conductive and non-conductive layers each include a silicone-containing material of the formula:

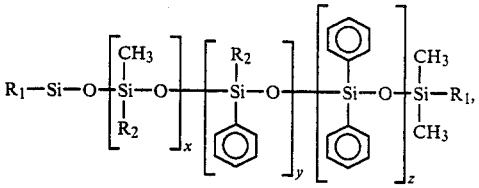

wherein $R_1$ is methyl, vinyl, or phenyl, $R_2$ is methyl or vinyl, and X+Y+Z equals 0 to about 2 million.

28 Claims, No Drawings

ELECTRICAL CONNECTOR

This invention pertains to resilient, self-aligning, electrical connectors having electrical contacts made of metal-filled or carbon-filled, resilient, elastomeric layers interposed between non-conductive elastomeric layers. The invention particularly pertains to methods for making layered elastomeric structures used to connect electrically two or more sets of electrical conductors proximately positioned in a one-to-one relationship, each set consisting of a plurality of closely spaced conductors positionally fixed with respect to each other.

Prior art connectors for electrically connecting two or more sets of electrical conductors such as tape cable connectors, plug-in printed circuit board connectors, integrated circuit connectors, liquid crystal display unit connectors and the like usually include complicated assemblies that have complex metal contacts for completing the electrical circuits. Examples of electrical connectors of the prior art are described in U.S. Pats. Nos. 3,971,610; 3,982,320, 4,257,661 and 4,344,662, as well as in Canadian Pat. No. 1,056,031. Some connectors include sharp-pointed contacts that are forced through insulation or insulating films bending, scratching and stressing the conductors to provide adequate electrical contact. Characteristic of most prior art devices are complicated electrical contacts in the form of ramps, rings, fingers and the like made of springy metal material which maintain engagement with the conductors by means of elastic deflection. These types of electrical contacts are usually expensive to make and difficult to assemble into a connector. Additionally, they have the disadvantages of being generally difficult to reproducably fabricate and when fabricated, occupying an undesirable amount of volume and subject to fatique when under continuous use.

Where two or more sets of electrical conductors are to be connected to each other, each set consisting of a large number of very small conductors closely aligned next to each other, the electrical contacts must in some measure assure exact alignment of the conductors so that each conductor of a first set will contact only with the correct corresponding conductor or conductors of a second set. This alignment is generally achieved by means of spaced apartures in the connectors that contain corresponding contacts. Where a large number of contacts are so situated or where repeated making and breaking of the contacts is experience, misalignment, wear, bending, shorting and other types of circuit failure are commonly experienced. Moreover, permanent or semi-permanent electrical connections of this type are undesireable or impossible. The metal or metal contacts experience surface abrasion due to the wiping action of the initial contact which, in time, corrodes thereby increasing the contact resistance. The actual contacting area of a metal to metal contact is typically less than one thousandth of the total surface area of the metal contact. If permitted, moisture and hostile atmospheres can migrate between the contact surfaces rapidly deteriorating the qualify of the electrical contact.

One area of major concern as pertaining to the durability of electrical conductors is low temperatures. In some applications, electrical conductors must withstand and operate at temperatures of −60° C. or less for periods of 15 days or more. An example of this type of application would be used in high performance electronic instrumentation which might be utilized by military, deep space, medical or other high reliability applications requiring reliable high density electrical connections. Many connectors at present, when subjected to extremely low temperatures, will tend to crack and break, thus breaking the electrical connections and between the conductors and preventing the devices in which these conductors are installed from operating properly.

These disadvantages can only be overcome by providing a connector which is compliant or conformal, and resilient, and which sealingly engages the contacts to be connected yet which presents substantially no surface abrasion during initial contact. It is therefore an object of this invention to create such a connector which is very simply and reproducibly fabricated from known materials by methods which are susceptable to utilization of low skill level manpower, low volume economy of scale and negligible waste of materials, as well as being able to withstand and operate at low temperatures such as those of −60° C. and below, for periods such as 15 days or more.

The present invention relates to a method of making a layered connector element for electrically connecting sets of spaced electrical conductors comprising the steps of: assembling alternatively in parallel relationship sheets of electrically conductive material and sheets of electrically non-conductive material, into a block structure wherein said electrically conductive material and said electrically non-conductive material include a silicone-containing material of the formula:

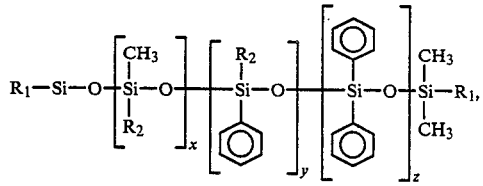

wherein $R_1$ is methyl, vinyl, or phenyl, $R_2$ is methyl or vinyl, and wherein X+Y+Z equals 0 to about 2 million, slicing from the block, a plane perpendicular to the plane of the sheets, a slab containing, alternatively, elongated elements of electrically conductive material and elongated elements of electrically non-conductive material, and slitting from the slab, in a plane to which the elongated elements of the slab are substantially normal, a layered connector. Preferably, X+Y+Z equals about 1,500,000. A layered connector may, in some embodiments, have a linear dimension along a direction perpendicular to the layers and being at least several times the largest linear dimension of any single layer.

A layered strip connector according to this invention can be produced by any of several methods, although certain methods are preferred over others due to economics of scale, adaptability to automation, uniformity and quality control. Generally, a sheet of non-conductive elastomer is sprayed, cast, molded, extruded or calendered and partially or fully cured. A sheet of conductive elastomer is sprayed, cast, molded, extruded or calendered on top of the previous sheet, or sprayed, cast, molded, extruded or calendered separately and placed on top of the previous sheet with any necessary binder included. The process of placing conductive sheets on top of non-conductive sheets is repeated many times to form a block consisting of a stack of sheets of an appropriate height. The stack of sheets is then post-cured to effect a binding between all the sheets. The stack is then sliced, approximately perpendicular to the sheets, to form slabs containing alternating elongated elements of conductive and non-conductive material. The slabs are then slit in planes in which the elongated elements are substantially normal to form a layered connector according to this invention.

A connector made according to this invention consists alternatively of layers of electrically conductive, elastomeric resin (which can be made conductive, in any known conventional manner) and non-conductive elastomeric resin alternatively interposed to form an electrical connection between two or more sets of approximately spaced electrical conductors. The electrical connector element exists independently of the sets of conductors and may be a strip of resilient material consisting of a series of metal-filled or carbon-filled, elastomeric resin layers interposed between non-conductive resin layers, the conductive layers forming the electrical contacts of the connector element. The conductive and non-conductive elastomeric resin layers include the silicone-containing material described above in accordance with the present invention. Generally, the number of layers per unit length of the connector strip will be selected such that at least one conductive layer and typically a plurality of electrically conductive and non-conductive layers contact each conductor as well as each space between adjacent conductors of any set. Since the number of layers is typically large in comparison to the number of conductors in any given situation, the connector effects a self-aligning function by permitting electrical contact only between corresponding conductors of two or more sets connected. The layers are substantially parallel to each other and are approximately perpendicular to the surface of the conductors contacted. The layers need not be of the same thickness and in some applications particular thicknesses for the conductive and/or non-conductive dimension of a layered connector perpendicularly transverse to the layers forming the connector is at least several and typically 10 to 100 times the largest linear dimension of any single layer forming the connector.

The silicone-containing material described above is used because of its aging and curing characteristics and its retention of physical characteristics of temperature extremes. The silicone containing material used in the present invention is a modified phenyl gumstock which has a brittle point temperature of about −155° F.

The elastomers used should be form stable when partially cured, that is, they should not deform unduly under their own weight, nor should they plastically deform after curing, but rather should be resiliently renitent.

It is, therefore, preferable that the connector consist only of alternating layers of conductive and non-conductive elastomeric resin. Greater ingegrity (i.e. unitary nature of the elastomeric material) can be assured by using the same elastomeric material for both the conductive and non-conductive layer the difference in conductivity resulting only from the choice of appropriate fillers.

A non-conductive elastomer is an elastomer having a volume resisitivity equal to or greater than $10^9$ ohm-cm. While the resistivity of the conductive layers can be varied over wide ranges, typically $10^{-4}$ to $10^4$ ohm-cm, low resistivity values are preferred to reduce problems such as thermal dissipation and capacitive interference, which can be experienced at the higher resistivity values.

In accordance with a preferred embodiment, the conductive layer which includes the silicone-containing compound used in the present invention is filled with a carbon black having a surface area from about 50 to about 1,500 square meters per gram.

Carbon black is also highly thermally conductive with lower ohm-cm values; thus, yielding higher thermal conductivity results in faster and more uniform distribution of heat and cold, which results in more uniform expansion and contraction throughout the material (not surface). Uneven heat transfer yields greater surface tension of the material and causes polymer breakdown and failure.

Silicone elastomers typically in the absence of conductive fillers, have a volume resistivity of $10^{14}$ and to $10^{15}$ ohm-cm and dielectric strength of about 500 volts per mil in a one-eighth inch thick sample.

Conductive elastomers having higher values of resistivity, 2 to 20 ohm-cm, are generally created by using a carbon-filled elastomer. An example of a carbon-filled conductive elastomer is Rhone-Poulenc silicone compound DS 328.

Conductive elastomers having lower values of resistivity, less than 2 to 20 ohm-cm, are created by incorporating into the elastomer conductive fillers such as copper, nickel and silver, and metal-coated fillers such as silver-coated copper, silver-coated nickel, and silver-coated glass. The metal-filled elastomers may also contain carbon to improve the physical characteristics of compression set and strength.

The resilient character of the elastomers involved assures a good electrical connection with the conductors by elastically deforming in response to external forces such as would be experienced upon insertion of the conductor set. This effects a vibrational absorbing and cushioning not available from undamped flexible metal connectors. This damped flexible supporting of the surface of the conductors also hermetically seals the conductor surface after contact has been made, thereby inhibiting corrosion by preventing the migration of hostile fluids to the contacting conductor surface. The connectors of this invention are easily reproduced over a wide range of contact resistance, hardness, layer thickness and other mechanical and electrical variables.

While the thickness of the layers can be varied substantially depending on the individual demands of the particular situation, for optimum design the layer thicknesses should be chosen so that there are as many conductive layers per unit length of the resulting connector element as possible while simultaneously avoiding any electrical malfunction caused by the proximity of the adjacent conductive layers under the intended conditions of use. While satisfactorily performing layered strip connectors can be made with elastomer layers as thin as 0.0003 inches and as thick as 0.125 inches from practical consideration of quality, ease of assembly, economy, etc., the layers need be no greater than 0.040 inches and should be no thinner than 0.001 inches. A one-to-one correspondence between the conductive layers of the connector and the conductors of one set of conductors may be desirable in particular situations. In some situations the individual layer dimensions are chosen with regard to the final connector dimensions such that the linear dimension of the connector perpendicularly transverse to the layers forming the connector is at least several times the largest linear dimension of any single layer forming the connector.

The layered connectors made according to this invention can have several configurations. In one embodiment, the connector can comprise simply a strip of substantially parallel alternate layers of conductive and non-conductive cured elastomer, the linear dimension of the strip perpendicularly transverse to the layers forming the strip being at least several times the largest linear dimension of any single layer present in the strip. In another embodiment, a plurality of the strips can be combined wtih means for retaining the strip in substantially fixed relation to one another. One such retaining means is formed from antipodally bordering lamina cured or vulcanized to the original block of alternately layered conductive adn non-conductive elastomers. Other retaining means may be formed independently of any shape, subject only to conventional choice of design. A strip of substantially parallel layers of conductive and non-conductive cured elastomer is then bonded to the periphery of the retaining means. Alternatively, slabs of elongated elements cut from a block of alternately layered elastomers can be bonded to a central core body. The central core body with the bonded layered elastomer slabs can then be cut in planes perpendicular to the elongated elements comprising the slabs into individual connectors.

In the broadest sense, the invention comprises means and method for making a means for connecting sets of spaced electrical conductors comprising recurrent, substantially parallel layers of conductive and non-conductive material bonded together in a unit, wherein said layers of conductive and nonconductive material include a silicone-containing material of the formula:

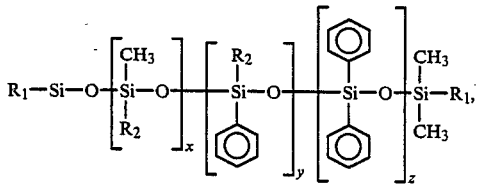

wherein $R_1$ is methyl, vinyl or phenyl, $R_2$ is methyl or vinyl, and $X+Y+Z$ equals 0 to about 2 million, preferably about 1,500,000.

Particular features and advantages of the invention will become apparent from the following description in conjunction wth the preceding summary and claims.

A layered strip connector containing alternate layers of conductive elastomeric resin and non-conductive elastomeric resin is bonded together to form a unitary structure. The surfaces are suitable for contacting sets of approximately positioned conductors for electrically connecting the sets of conductors. Electrical conduction can take place in either direction, between the surfaces, through the layers of conductive elastomer, while substantially no electrical conduction takes place through the layers of non-conductive elastomer. The individual conductive layers are therefore insulated from each other.

A connector according to this invention is constructed by assemblying by molding, casting, or some other method, a plurality of sheets of conductive and non-conductive clastomers alternate to from a layered block. The block is cured sufficiently to ensure physical integrity of the block so as to prevent any layer separation to any subsequent step in the manufacturing procedure or during use. The cured block is then sliced in a plane perpendicular to the lanes of the individual sheets forming the block to provide slabs.

The slabs in a preferred embodiment, consist of a plurality of rods of conductive elastomes and rods of non-conductive elastomer, bonded together. The rods of conductive elastomer are conductive not only through the thickness of the slab, but also longitudinally through the length of the conductive rods. The slabs are then slit perpendicular to the rods to form the connecting strips. The strips can be used either individually or in combination with other similar strips to form layered connectors according to this invention. In general, the linear dimension of the strip perpendicularly transverse to the layers and the strip is at least several times and typically 10 to 100 times the largest linear dimension of any single layer.

The assembling of the sheets of electrically conductive and non-conductive material into a block may be preformed by several different methods. As example of the production of a block ready for slicing containing carbon-filling silicone rubber for the conductive layers is as follows: a plurality of insulating sheets 1 in.×4 in.×0.010 in. were produced by pressing for one minute at 340° F. until partially cured. Conductive sheets 2 in.×4 in.×0.010 in. were produced and pressed for one minute at 450° F. until partially cured. The conductive and non-conductive sheets were stacked alternatively to produce a block ¼ in. high. Four such blocks were stacked to form a block 1 in. high. This block was cured in a press for one-half hour at 450° F. and post-cured without pressure for four hours at 350° F.

The block was then sliced into slabs 2 in.×1 in.×0.100 in. The slabs were then slit into connecting strips 1 in.×0.050 in.×0.100 in. Each layer within the connecting strip has linear outside dimensions of 0.010 in.×0.050 in.×0.100 in. and the diagonal linear dimension through the center of the layer was calculated to be approximately 0.112 in. The linear dimension of the connecting strip perpendicularly transverse to the layers forming the strip (1 in.) is, therefore, at least several times the largest linear dimension of any single layer (0.112 in.).

An example of the production of the layered connector containing silver filled silicone elastomer 2 in.×4 in.×0.010 in. were produced in the same manner as in the previous example. Layers of conductive silicone elastomer were produced, blended, and pressed into uncured layers 2 in.×4 in.×0.010 in. The conductive and non-conductive layers were alternatively stacked to produce a block ¼ inch high. Four such blocks were stacked to form a block 1 inch high. This block was cured at 450° F., for one-half hour in a press and then post-cured without pressure for 4 hours at 350° F. This block was sliced in a manner similar to the previous example to form connector strips 1 inch by 0.050 inches by 0.100 inches.

Blocks of sheets suitable for slicing into connectors can also be produced by fully curing the conductive and non-conductive sheets of the foregoing examples separately, interleafing the sheets of conductive elastomer with those of the non-conductive elastomer with a curable adhesive in between, and subsequently curing under pressure.

Blocks may also be produced by casting a layer of non-conductive elastomer and partially curing that layer, casting a layer of conductive elastomer onto the non-conductive layer and partially curing the second layer, continuing to cast and cure alternate layers of conductive and non-conductive elastomers until forming a block of the desired dimension and finally curing the block to ensure that the sheets do not separate. This method may also be used with molding rather than casting.

Another method for producing blocks of sheets suitable for slicing into connectors, according to this invention, comprises extruding long continuous lengths, typically up to 800 feet long and 3 to five inches wide, and particularly during the long continuous lengths of non-conductive elastomer to a state that it is easily handled and does not deform under its own weight. The long continuous strip of non-conductive elastomer is then used as a base or substrate upon which a continuous layer of electrically conductive elastomer can be extruded or calendered as a continuous layer. The continuous layer of conductive elastomer along with the strip of non-conductive elastomer is then wound on an octagonal drum or other similarly shaped drum. The drum has sides that are typically about 10 inches in length. The thickness of the conductive and non-conductive layers is typically 0.010 inches. The drum is rotated until 50 to 100 layers of the conductive and non-conductive elastomer are wound one on top of the other. The drum is then stopped and the multiple layers formed on each surface are removed from the drum by cutting. The multiple layers are then cured under pressure, either individually or stacked together to result in a block. This block can then be sliced into slabs and then slit into layered strips.

An apparatus such as a liquid-crystal display unit can be electrically connected to a printed circuit board by layered strip connectors. Each of the electrical conductors on the printed circuit board is roughly positioned to correspond with a conductor on the display unit. The electrically conductive layers of the connector permit electrical current to travel between each of the corresponding conductors. The non-conductive layers prevent electrical current from traveling to non-corresponding conductors. The number of layers present in the connector is typically several times the number of conductors on the printed circuit board.

The resilient character of the elastomers used in producing the connector cushions and absorbs shock and vibration between the apparatus and the circuit board. The smooth compliant surface of the connector seals the surface of the conductors after contact inhibiting contact corrosion.

A connector consisting of a number of layered connector element retained in substantially fixed relation to one another by a retaining means can be advantageously used in the place of an independent strip connector. The retaining means can be either conductive or non-conductive as the particular situation might demand.

A number of layered connector elements can also be conveniently made by sandwiching a layered block of elastomers between two laminae. The two laminae can be multilayered, but to achieve greatest strength, they preferably are made of single layers of an elastomer which is fully compatible with the elastomer used to form the individual layers of a block. The layered block of elastomers and the antipodally bordering laminae are cured or vulcanized together to form a single block from which slabs can be sliced.

The slab consists of elongated elements, similar which are formed from the layered elastomers and are alternatingly conductive and non-conductive, bounded by bordering elements formed from the laminae. One or more connectors can be cut, stamped, punched or otherwise formed from the slab. The waste from this process can be used to form other layered connecting elements generally according to this invention. The bordering elements of the slab form the retaining means of the connector. The connector can be viewed as a slab having at least one inside edge defining an orifice through the slab.

Another connector according to this invention, having particular utility in connecting very small, fragile electrical circuit elements such as integrated circuit chips and the like can be made by bonding one or more slabs of elongated elements of alternately conductive and non-conductive elastomers and to a body. The body acts as a retaining means for substantially fixing the physical relationship between the slabs.

The body and slabs are then cut in planes to which the layers of conductive and non-conductive elastomer and are essentially perpendicular thus forming a connector.

The connector comprises a central portion having upper and lower surfaces bounded by and joined by a periphery. Fixed to the periphery is a plurality of strips, each strip comprising alternate layers of electrically conductive and electrically non-conductive elastomer, and each layer extending between and being coterminus with the upper and lower surfaces. The central portion can be tailored to have any shape desired, whether it be rectangular, circular, or other convenient shape. The central portion functions as a retaining means to fix the physical relationships between the two strips. The upper and lower surfaces, while generally being parallel to each other, can be skewed, one with respect to another, in certain circumstances. In general, the area of the periphery is less than the area of either the upper surface of or the lower surface. Further, the linear dimension of each strip transversely perpendicular to the alternate layers and forming the strip is at least several times the greatest linear dimension of any of the alternate layers forming the strip.

Although the invention has been described in considerable detail with reference to certain preferred embodiments thereof, it will be understood that variations and modifications can be effected within the spirit and scope of the invention as described above and as defined in the accompanying claims.

What is claimed is:

1. A method of making a layered connector element for electrically connecting sets of spaced electrical conductors comprising the steps of:

assembling alternately in parallel relationship sheets of electrically conductive material and sheets of an electrically non-conductive elastomer, into a block structure, wherein siad electrically conductive material and said electrically non-conductive elastomer include a silicone-containing material of the formula:

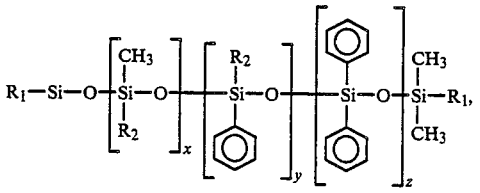

wherein $R_1$ is methyl, vinyl, or phenyl, $R_2$ is methyl or vinyl, and X+Y+Z equals 0 to about 2 million;

slicing from the block, in a plane perpendicular to the planes of the sheets, a slab containing, alternately, alongated elements of electrically conductive material and alongated elements of electrically non-conductive elastomer; and slitting from the slab, in a plane to which the elongated elements of the slab are substantially normal, a layered connector.

2. The method of claim 1 wherein X+Y+Z equals about 1,500,000.

3. The method of claim 1 wherein said assembling of alternately parallel sheets of electrically conductive material and electrically non-conductive elastomer.

(1) casting an incompletely cured sheet of said electrically non-conductive elastomer.

(2) casting an incompletely cured sheet of electrically conductive elastomer on top of the sheet formed in step 1), (3) continuing to cast alternately sheets of non-conductive and conductive elastomer on top of the sheets previously formed until a stack containing the desired number of sheets of elastomer is obtained, and (4) completely curing the stack of elastomer sheets into a single block structure.

4. The method of claim 3 wherein molding is performed in any instance where casting might otherwise be performed.

5. The method of claim 1 wherein said assembling of alternately parallel sheets comprises interleafing cured layers of elastomer with an incompletely cured elastomer to form a stack of alternating layers of cured and uncured elastomer, and curing the stack into a single block structure.

6. The method of claim 5 wherein the cured layers of elastomer are non-conductive and the incompletely cured elastomer is electrically conductive when subsequently cured.

7. The method of claim 1 wherein said assembling of alternately parallel sheets comprises the steps of:

(1) extruding an incompletely cured sheet of electrically non-conductive elastomer, (2) forming an incompletely cured sheet of electrically conductive elastomer on top of the sheet formed in step (1), (3) winding the two strips together on a multifaced drum, thereby forming stacks of alternately electrically conductive and non-conductive elastomer, one stack on each facet of the drum, (4) removing each stack from the drum and curing under pressure into a block structure.

8. The method of claim 1 wherein said slicing from said block further comprises bonding a plurality of said slabs to a body such that the slabs are fixed wtih respect to each other and the alternately elongated elements of each slab are essentially parallel to each other.

9. The method of claim 8 wherein said slitting from said slab comprises slitting from the plurality of slabs fixed to the body, in a plane to which the elongated elements of the slabs are substantially normal, a plurality of layered connector strips and means for retaining the connector strips in fixed relation one to another, the linear dimension of each connector strip along a direction perpendicular to the layers and passing therethrough being at least several times the largest linear dimension of any single layer in any strip.

10. An electrical connector for connecting at least two sets of spaced electrical conductors, the connector having a plurality of layered strips, each strip comprising substantially parallel alternative layers of electrically conductive and non-conductive cured elastomer, wherein said electrically conductive layered and non-conductive cured elastomer include a silicone-containing material of the formula:

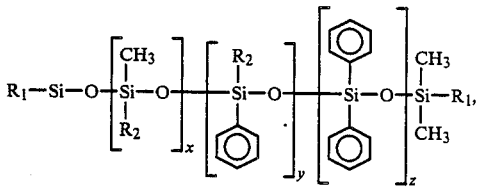

wherein $R_1$ is methyl, vinyl, or phenyl, and $R_2$ is methyl or vinyl, and X+Y+Z equals 0 to about 2 million, and each layer extending through the connector between two surfaces adapted to receive the two sets of spaced electrical conductors, and the linear dimension of each strip being along a direction perpendicular to the layers and passing therethrough.

11. The electrical connector of claim 10 wherein X+Y+Z is about 1,500,000.

12. A system electrically connecting at least two sets of spaced electrical conductors, a strip of substantially parallel alternate layers of conductive and non-conductive cured elastomer, wherein said conductive layer and said non-conductive cured elastomer including a silicone- containing material of the formula:

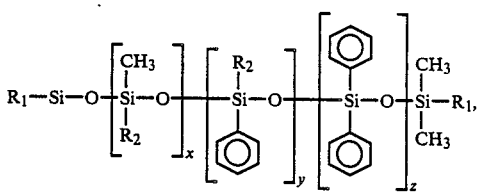

wherein $R_1$ is methyl, vinyl, or phenyl, $R_2$ is methyl or vinyl, and X+Y+Z equals from 0 to about 2 million, and the linear dimension of the strip is along a direction perpendicular to the layers and passing therethrough.

13. The system of claim 12 wherein X+Y+Z equals about 1,500,000.

14. The strip of claim 12 wherein the layers are between 0.0003 and 0.125 inches thick.

15. The strip of claim 12 wherein the layers are between 0.001 and 0.040 inches thick.

16. The strip of claim 12 wherein the number of layers in the strip is greater than the number of conductors in any said set of conductors.

17. The strip of claim 12 wherein the layers are approximately perpendicular to the surfaces of said sets of conductors.

18. A layered strip connector for electrically connecting sets of spaced electrical conductors comprising alternate layers of conductive and non-conductive cured elastomer, wherein said conductive layer and said non-conductive cured elastomer include a silicon- containing material of the formula:

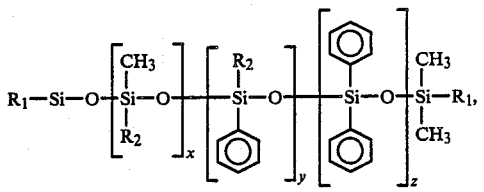

wherein $R_1$ is methyl, vinyl, or phenyl, $R_2$ is methyl or vinyl, and X+Y+Z equals 0 to about 2 million, said layers having a thickness between 0.0003 and 0.125 inches, the linear dimension of the connector along a direction perpendicular to the layers and passing therethrough.

19. The layered strip connector of claim 18 wherein X+Y+Z equals about 1,500,000.

20. The layered strip connector of claim 18 wherein the layers have a thickness between 0.001 and 0.040 inches.

21. The layered strip connector of claim 18 wherein the layers are approximately perpendicular to the longitudinal surfaces of the strip.

22. An electrical connector for connecting at least two sets of spaced electrical conductors, the electrical connector comprising a plurality of elements, such element comprising a strip of substantially parallel alternate layers of electrically conductive and non-conductive cured elastomer, wherein said electrically conductive layer and said non-conductive cured elastomer include a silicone-containing material of the formula:

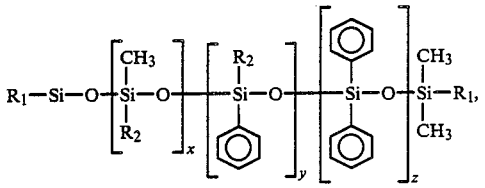

wherein $R_1$ is methyl, vinyl, or phenyl, $R_2$ is methyl or vinyl, and X+Y+Z equals 0 to about 2 million, the linear dimension of the connector being along a direction perpendicular to the layers and passing therethrough.

23. The electrical connector of claim 22 wherein X+Y+Z equals about 1,500,000.

24. The electrical connector of claim 22 further comprising means for retaining at least two of said elements in substantially fixed relation one to another.

25. The electrical connector of claim 24 wherein said means is an elastomer cured to the said at least two elements.

26. Two sets of spaced electrical conductors and an electrical connector for connecting the two sets of spaced electrical conductors, the two sets of electrical conductors proximately positioned on opposite sides of the electrical connector, each set comprising a plurality of closely spaced conductors positionally fixed with respect to each other, the electrical connector comprising alternate layers of conductive and non-conductive cured elastomer, wherein said conductive layer and said non-conductive cured elastomer include a silicon - containing material of the formula:

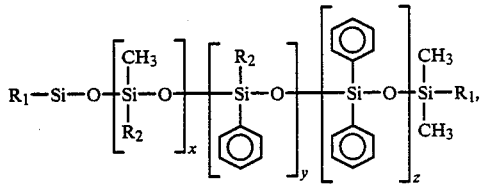

wherein $R_1$ is methyl, vinyl, or phenyl, $R_2$ is methyl or vinyl, and X+Y+Z equals 0 to about 2 million, and the linear dimension of the electrical connector being along a direction perpendicular to the layers and passing therethrough.

27. The two sets of electrical conductors of claim 26 wherein X+Y+Z equals about 1,500,000.

28. The combination of claim 26 wherein each layer of the electrical connector is between 0.001 inches thick and the liner dimension of the connector along a direction perpendicular to the layers and passing therethrough is at least 20 times the thickness of any single layer.

* * * * *